US008146681B2

(12) United States Patent
Heemann et al.

(10) Patent No.: US 8,146,681 B2
(45) Date of Patent: Apr. 3, 2012

(54) DRILLING TOOL AND DRILLING METHOD

(75) Inventors: Kay Heemann, Kaufering (DE); Uwe Bohn, Kissing (DE); Wolfgang Ludwig, Zaisertshofen (DE)

(73) Assignee: Hilti Aktiengesellschaft, Schaan (LI)

( * ) Notice: Subject to any disclaimer, the term of this patent is extended or adjusted under 35 U.S.C. 154(b) by 255 days.

(21) Appl. No.: 12/587,914

(22) Filed: Oct. 14, 2009

(65) Prior Publication Data

US 2010/0089644 A1 Apr. 15, 2010

(30) Foreign Application Priority Data

Oct. 15, 2008 (DE) ..... 10 2008 042 846

(51) Int. Cl.
*E21B 21/08* (2006.01)
*E21B 44/02* (2006.01)

(52) U.S. Cl. ..... 175/27; 175/25; 175/38; 175/122

(58) Field of Classification Search ..... 175/25, 175/27, 38, 113, 114, 122, 162
See application file for complete search history.

(56) References Cited

U.S. PATENT DOCUMENTS

| | | | | |
|---|---|---|---|---|
| 2,843,361 | A * | 7/1958 | Miller | 175/38 |
| 5,121,802 | A | 6/1992 | Rajala | |
| 5,409,072 | A | 4/1995 | Enlund | |
| 2005/0006143 | A1 * | 1/2005 | Uitto | 175/27 |

FOREIGN PATENT DOCUMENTS

| | | |
|---|---|---|
| DE | 34 03 502 | 6/1984 |
| GB | 2004 782 | 4/1979 |
| GB | 2037 630 | 7/1980 |
| WO | WO 97/47858 | 12/1997 |

* cited by examiner

*Primary Examiner* — Brad Harcourt
(74) *Attorney, Agent, or Firm* — Abelman, Frayne & Schwab

(57) ABSTRACT

A drilling tool includes a hydraulically driven device (21) for advancing a drilling head (2) in a bore (5), and a flow limiter (30) arranged in a hydraulic conduit (25) of the advancing device (21) for adjusting an advancing speed of the drilling head (2) in the bore (5), with the flow limiter (30) having a pressure-actuated adjusting member (38) for adjusting flow of a hydraulic fluid in the hydraulic conduit means (25) in accordance with a flow volume of a rinsing fluid (7) for rinsing the bore.

10 Claims, 2 Drawing Sheets

DRILLING TOOL AND DRILLING METHOD

BACKGROUND OF THE INVENTION

1. Field of the Invention

The present invention relates to a drilling tool for and a drilling method of drilling bores in rock formations in mines.

2. Description of the Prior Art

In mines, the rock formation is formed of diverse layers. In addition to desired extraction products, e.g., coal, ore, the mine rock formations contain loam layers.

A load applied to a drilling tool varies with varying of the rock formation layers. At a pure manual operation, the tool user should adapt an advancing speed of a drilling head to the layer sequence. In particular, in the loam layers, a slow advance is required so that the glutinous loam is rinsed out of the bore and would not set around the drilling head.

In practice, a tool user has only an approximate knowledge of the position of separate layers. Therefore, the user is forced to work with a small advancing speed.

U.S. Pat. No. 6,637,522 discloses an automated process that should protect the tool from an overload. The bore is rinsed with a pressurized drilling fluid during drilling. A control sensor detects the pressure of the rinsing fluid. An electrical control device controls advance of the drilling head dependent on the measured pressure.

However, in mines, open mines, because of humidity and mechanical loads, the connections and contacts of power supply and control system should meet very stringent requirements. Correspondingly, the costs of an available electrical supply should be taken into account.

An object of the present invention is to provide an automated drilling method and a corresponding drilling tool without use of control electronics.

SUMMARY OF THE INVENTION

This and other objects of the present invention, which will become apparent hereinafter, are achieved by providing a drilling tool having a hydraulically driven device for advancing a drilling head in a drilled bore, and rinsing means for rinsing the bore with a rinsing fluid. A flow limiter is arranged in the hydraulic conduit of the advancing device for adjusting an advancing speed with which the advancing device advances the drilling head in the bore. The flow limiter has a pressure-actuated adjusting member for adjusting flow of a hydraulic fluid in the hydraulic conduit in accordance with the pressure of the rinsing fluid. For transmitting the pressure of the rinsing fluid to the adjusting element, there is provided at least one of pneumatic, hydraulic, and mechanical elements that connects that adjusting member with the rinsing means.

In the drilling tool, the advancing speed of the drilling head is controlled, dependent on the pressure of the rinsing fluid used for rinsing the bore. The pressure of the rinsing fluid increases when the rinsing fluid is not able to expel the drillings with an adequate delivery rate. As a result, the bore starts to clog. This can happen, e.g., during drilling in a loam layer. In this case, the flow limiter limits the flow of the hydraulic fluid to the advancing device. Preferably, the advancing speed is reduced until the rate of removal of drillings is such that the delivery rate of the rinsing fluid is reduced.

Dependent on the system, a pressure gradient between an inlet and an outlet of the flow limiter can be controlled. When the flow limiter blocks the flow of the hydraulic fluid, the hydraulic pump maintains the inlet-side pressure, whereas the outlet-side pressure falls due to the advance of the advancing device. Therefore, the flow limiter can also be called a pressure reducer.

The control is preferably realized without interposed control or regulation electronics. Only, passive pneumatic, hydraulic, and/or mechanical components should be used.

Electronic components require an electrical supply that need, in part, be additionally made available in mines and open mines. Further, high costs are involved in protection of electrical plug and socket connections and similar contacts against a humid corroding environment and vibrations.

According to the inventive drilling method, a drill is advanced in a bore with a hydraulically driven advancing device. The advancing speed is set with a flow limiter arranged in the hydraulic conduit of the advancing device. During drilling, the bore is regularly rinsed with a rinsing fluid, e.g., water. As a result, drillings are removed out of the bore. The pressure-actuated adjusting member of the flow limiter is connected with the rinsing circuit.

According to one embodiment of the present invention, the flow limiter includes a valve that prevents flow of the hydraulic fluid when the pressure applied to the adjusting member exceeds an upper threshold value. At a lower threshold value, the valve should be, preferably, completely open. In the simplest case, the control can take place just by opening and closing the valve. Supply elements, e.g., hysteresis elements, can improve the control characteristics, in particular, hysteresis elements that slow down opening of the valve.

According to a modified embodiment, the valve is formed as a proportional valve for adjusting the flow of the hydraulic fluid or the pressure at its outlet proportionally to the pressure applied to the adjusting member. The valve, in this case, operates with a smaller stroke and a uniform control mode. Thereby, a mechanical load applied to the valve can be reduced.

For controlling the proportional dependence between the flow of hydraulic fluid and the pressure applied to the adjusting member, a manually operable adjusting element can be provided. There also can be provided a further adjusting element for adjusting the upper or lower threshold value. Thereby, the control mode of the drilling tool can be adapted to local requirements.

The further adjusting element can be so connected, in a force-transmitting manner, with the advancing device that the upper threshold value increases as the advance increases. With an increasing bore depth, the pressure necessary for rinsing the bore also increases. Therefore, it could be expedient to adapt the characteristic curve of the control mode automatically to the bore depth.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENTS

Figure 1:
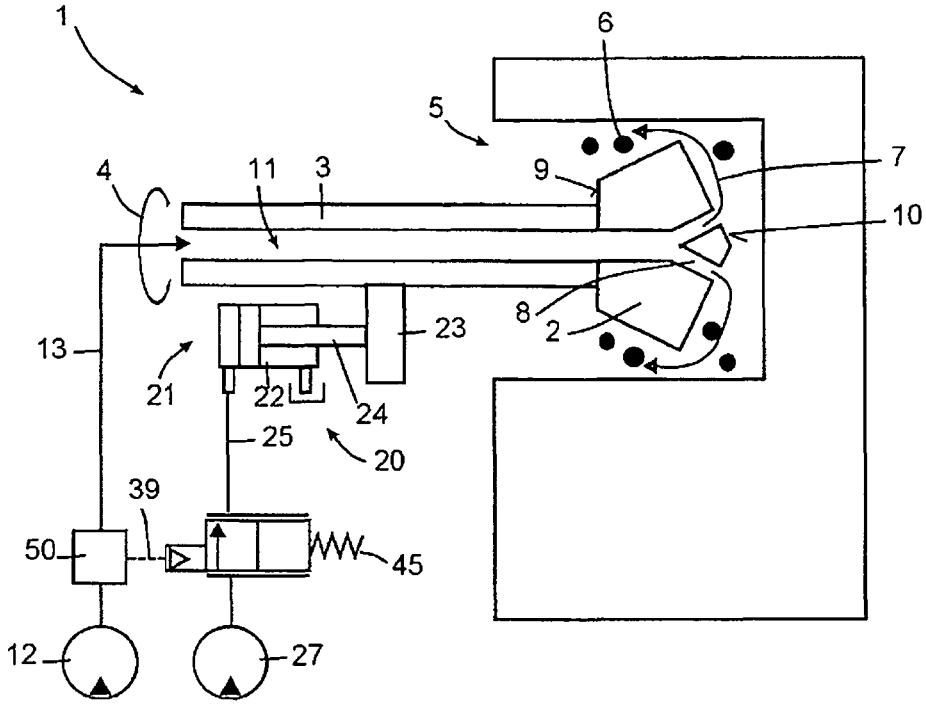
FIG. 1 a schematic view of a first embodiment of a drilling tool according to the present invention.

A drilling tool 1 according to the present invention, a first embodiment of which is schematically shown in FIG. 1, has a drilling head 2 secured on an anchor 3. The drilling tool 1 rotates the anchor 3 about a longitudinal axis 4 of the anchor 3. The drilling head 2 forms a bore 5 in a rock formation.

The produced drillings 6 are removed from the bore 5 with a rinsing fluid 7. The drilling head 2 has channels 8 which connect a rear side 9 of the drilling head 2 with its front side 10. The rinsing fluid 7 is fed to the drilling head 2 through a longitudinal channel 11 provided in the anchor 3. The rinsing fluid 7 is delivered by a delivery pump 12 through a conduit 13 connected with the hollow anchor 3. The drillings 6 are forced from the bore 5 by the rinsing fluid 7 sidewise of the drilling head 2. As rinsing fluid 7, water or another liquid can be used. Alternatively, a compressed air can be used. According to one of the embodiment, the air is not forced through but is rather aspirated.

There is further provided an advancing device 20 for receiving and advancing the anchor 3.

The advancing device 20 has a hydraulic drive 21. In the embodiments shown in the drawings, the drive 21 includes one or several hydraulic cylinder(s) 22. A piston element 24 is displaced out of the cylinder 22 by an injected, into the cylinder 22, hydraulic fluid. Suitable retaining elements 23 forcelockingly connect the anchor 3 with the piston 24, with the anchor 3 being driven in the bore 5 in accordance with a displacement speed of the piston 24.

The hydraulic fluid is fed to the cylinder 22 by a pump 27 connected with the cylinder 22 by hydraulic conduits 25 and a flow limiter 30.

The flow limiter 30 is formed as a control element for controlling the displacement speed of the piston 24 or the advancing speed of the drilling head 2. The flow volume of the hydraulic fluid delivered to the hydraulic drive 21 is limited by the flow limiter 30. The smaller is the flow volume, the smaller is the advancing speed of the drilling head 2. With the drive 21, including the cylinder 22, the advancing speed of the drilling head 2 is proportional to the flow volume.

The flow limiter 30 has a control member 38 that limits the flow under pressure acting thereon. The pressure-actuated control member 38 is subjected to pressure of the rinsing fluid at 39. In a simplified embodiment, the rinsing fluid 7 immediately contacts the pressure-actuated control member 38. A coupling element 50 can be formed by a T-piece or another functional element provided in the rinsing fluid conduit 13.

Alternatively, additional mechanical, pneumatic and/or hydraulic elements can be interposed. Additional elements can include a mechanical lever, a hydraulic press, etc. in order to provide for a desired dependence of the force acting on the control member 38 on the pressure of the rinsing fluid.

Further, the coupling element 50 can contain a sequence valve. The sequence valve communicates pressure from the coupling element 50 to the pressure-actuated control element 38 only when the pressure exceeds a certain threshold value.

The force-transmitting connection 39 of the rinsing fluid 7 with the flow limiter 30 provides for reduction of the advancing speed of the anchor 3 with increase of the pressure of the rinsing fluid 7. When the openings in the drilling head 2 are blocked, e.g., upon passing through loam-containing layers, the pressure of the rinsing fluid 7 is increased. If the pressure is increased above an upper threshold value, the flow limiter 30 should prevent further delivery of the hydraulic fluid, whereby a further advance of the drilling head ends. The upper threshold value can be determined dependent on the maximal pressure that can be provided by the delivery pump 12. The upper threshold value can lie in a range from 60% to 90%, e.g., amounts to 80% of the maximal pressure. When the pressure of the rinsing fluid 7 falls below the lower threshold value, a maximum flow should be insured. The lower threshold value can be selected, e.g., so that it is smaller than the upper threshold value by from 20% to 30%.

The flow limiter 30 can be formed, e.g., as a proportional valve, selector valve, flow valve. The valve can be formed in diverse forms. The valve can limit the flow directly or indirectly, at indirect limiting, the upper threshold value of the pressure can be preset at the outlet of the valve. The flow is then determined dependent on the pressure gradient between the inlet and the outlet ports of the valve. As a suitable valve, a proportional valve or a throttle valve can be used. Proportional and throttle valves can serve as an example of suitable valves. At the direct limitation, the upper threshold value of the flow is set. An example of suitable valves in this case is flow control valves.

Figure 2:
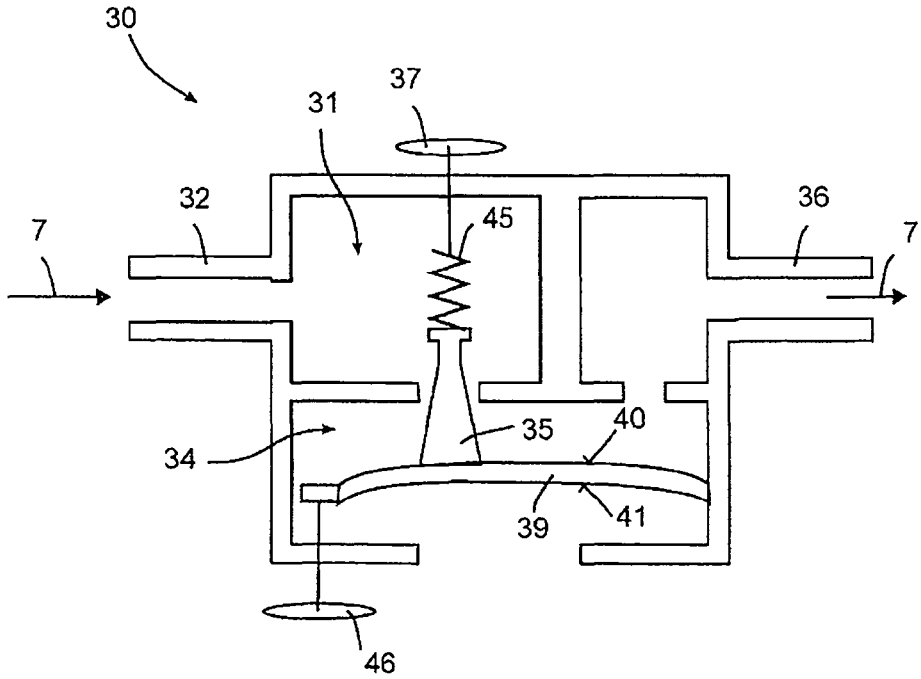
FIG. 2 a cross-sectional view of a flow limiter of the inventive drilling tool.

An example of the flow limiter 30 is shown in FIG. 2. The hydraulic fluid flows from an inlet port 32 into a first chamber 31. From the first chamber 31, the hydraulic fluid can flow through an opening 33 in a second chamber 34. The opening 33 can be closed partially or completely by a mandrel 35. This permits to achieve limitation of the flow. From the second chamber 34, the hydraulic fluid flows out through an outlet port 36.

The limitation of the flow cross-section of the opening 33, i.e., the upper threshold of the flow is determined by a relative position of the mandrel 35 with respect to the opening 33. The mandrel 35 can be displaced by a manually operable adjusting element 37 such as, e.g., an adjusting screw. The user can adjust the advancing speed of the anchor 3 with the adjusting element 37. The flow through the flow limiter 30 is adjusted with the pressure-sensitive adjusting member 38 that is formed by a diaphragm 39. The mandrel 35 is supported on an inner side 40 of the diaphragm 39. The pressure that is applied to the adjusting member 38 acts on an outer side 41 of the diaphragm 39. The diaphragm 39 is pressed into the second chamber 34, whereby the mandrel 35 increasingly closes the opening 33.

The pump 27 is designed with an adequate delivery power so that it does not limit the flow in any way. However, the maximal possible pressure which is available from the pump, can change between different mines and galleries. Therefore, it is advantageous to provide a possibility of adjustment of the upper and lower threshold pressure values of the hydraulic fluid at which no advance or maximum advance is desired.

The manually operable adjusting element 37 can, optimally, cooperate with a spring 45 to counteract the action of the pressure-actuated adjusting member 38. Thereby, increase of pressure of the rinsing fluid 7 can be used for changing the flow rate. Optionally, the upper threshold can be adjusted by an adjusting element 46 that adjusts the rest or zero position of the mandrel 35 at the opening 33. With the adjusting element 46, the suspended position of the diaphragm 39 can be varied.

According to one of the embodiments of the present invention, the advancing device 21 is coupled with the adjusting elements 37 and 46 forcelockingly, i.e., mechanically, hydraulically, pneumatically. At that the more the upper threshold value increases, the further the advancing device 21 advances the drilling head 2. The coupling can be actuated directly by the piston 24.

Figure 3:
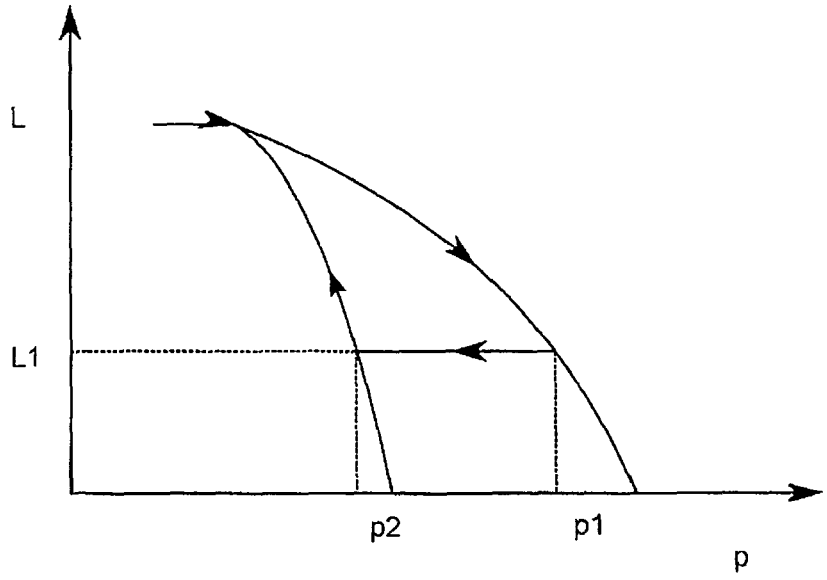
FIG. 3 a hysteresis curve of the flow limiter.

The flow limiter can be realized with hysteresis (FIG. 3). At a first pressure p1 of the rinsing fluid 7, the flow falls below a nominal value L1. The nominal value L1 of the flow only changes at a second pressure p2 of the rinsing fluid.

The second pressure p2 is smaller than the first pressure p1. The hysteresis enables a quieter control mode.

The flow limiter can be formed as a simple valve that is either completely open or closed.

Figure 4:
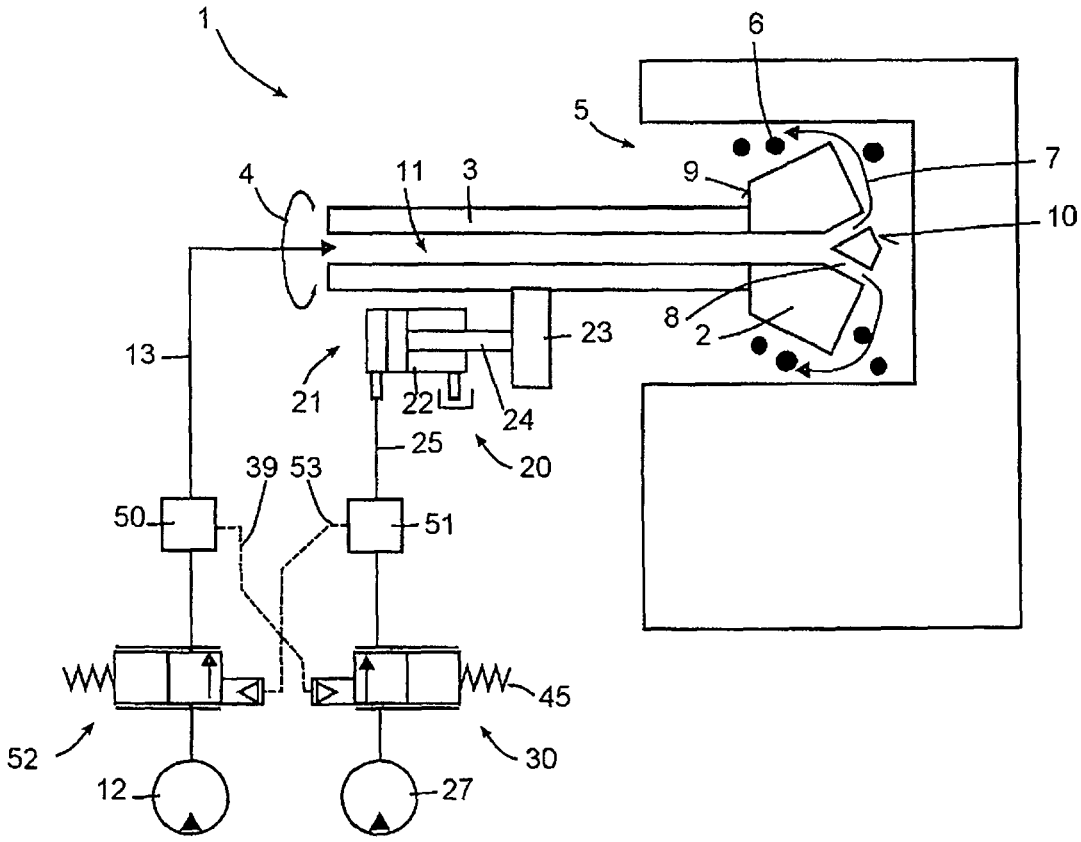
FIG. 4 a schematic view of a second embodiment of a drilling tool according to the present invention.

FIG. 4 shows a further embodiment of drilling tool 1. A proportional valve 52 is provided in the conduit 13 for the rinsing fluid 7. The proportional valve 52 is preferably arranged upstream of the coupling element 50. A pressure-dependent adjusting member of the proportional valve 52 is subjected to the action of the hydraulic fluid. The adjusting member reacts in response to the application of force or pressure. The coupling is preferably effected in a force-transmitting manner, i.e., mechanically, hydraulically, and/or pneumatically. A corresponding coupling device that can be formed as the coupling device 51, is arranged downstream of the flow limiter 30.

The proportional valve 52 increases the flow volume when pressure applied to its control inlet, increases. The increase can be affected stepwise, preferably, with four or more steps. The proportional valve 52 can have adjusting elements that set the threshold values to which the proportional valve 52 reacts or the flow is completely blocked.

The function of the proportional valve 52 is to save rinsing fluid. The tests showed that with an increasing advancing speed of the drilling head 2, a greater flow volume of the rinsing fluid is needed to prevent clogging. The minimal flow volume almost linearly depends on the advancing speed. The proportional valve 52 can be so adjusted that the flow volume is automatically adapted, using the forcelocking coupling, to the advancing speed.

Instead of the proportional valve 52, other flow limiters can be used. The flow limiter, the proportional valve 52, in the conduit 13 of the rinsing fluid differs from the flow limiter 30 in the hydraulic conduit 25 by an opposite reaction of its adjusting element to increase of pressure. The flow of the rinsing fluid increases when the pressure applied to the adjusting element, i.e., the pressure of the hydraulic fluid increases. The flow of the hydraulic fluid is reduced when the pressure applied to the corresponding adjusting element, i.e., the pressure of the rinsing fluid increases.

Though the present invention was shown and described with references to the preferred embodiments, such are merely illustrative of the present invention and are not to be construed as a limitation thereof, and various modifications of the present invention will be apparent to those skilled in the art. It is therefore not intended that the present invention be limited to the disclosed embodiments or details thereof, and the present invention includes all variations and/or alternative embodiments within the spirit and scope of the present invention as defined by the appended claims.

What is claimed is:

1. A drilling tool, comprising:

a drilling head (2) for forming a bore (5);

a hydraulically driven device (21) for advancing the drilling head (2) in the bore (5);

rinsing means (8, 11, 12) for rinsing the bore (5) with a rinsing fluid (7);

a first flow limiter (30) arranged in hydraulic conduit means (25) of the advancing device (21) for adjusting an advancing speed with which the advancing device (21) advances the drilling head (2) in the bore (5), the first flow limiter (30) having a pressure-actuated adjusting member (38) for adjusting flow of a hydraulic fluid in the hydraulic conduit means (25) in accordance with flow of the rinsing fluid (7) in the rinsing means;

means for transmitting pressure of the rinsing fluid to the adjusting member (38) and formed as at least one of mechanical, hydraulic and pneumatic element for actuating the adjusting member (38) in response to change of pressure of the rinsing fluid (7), and a second flow limiter (52) arranged in conduit means for rinsing means and having a pressure-actuated adjusting member subjectable to pressure of the hydraulic fluid.

2. A drilling tool according to claim 1, wherein the transmitting means defines a power path between the adjusting member (38) and the rinsing fluid (7).

3. A drilling tool according to claim 2, wherein the first flow limiter (30) comprises a valve for preventing flow of the hydraulic fluid when the pressure applied to the adjusting member (38) exceeds an upper threshold value.

4. A drilling tool according to claim 3, wherein the first flow limiter (30) comprises a manually operable adjusting element (37) for changing proportionality of dependence of the one of flow of the hydraulic fluid and pressure at the outlet on the pressure applied to the adjusting member (38).

5. A drilling tool according to claim 4, wherein the further adjusting element (46) increases the upper threshold value in response to increase of the advancing speed of the drilling head (2).

6. A drilling tool according to claim 2, wherein the valve is formed as a proportional valve for adjusting one of flow of the hydraulic fluid and pressure at an outlet thereof in accordance with pressure applied to the adjusting member (38).

7. A drilling tool according to claim 6, wherein the first flow limiter (30) comprises a further adjusting element (46) for adjusting one of the upper threshold and a lower threshold.

8. A drilling tool according to claim 1, wherein the second flow limiter (52) increase flow of the rinsing fluid with increase of pressure applied to the adjusting member thereof.

9. A method of forming bores in rock formations, comprising the steps of:

advancing a drilling head (2) in a bore (5) with a hydraulically driven advancing device (21);

adjusting an advancing speed with which the advancing device (21) advances the drilling head (2) in the bore (5) with a first flow limiter (30) that adjusts flow of a hydraulic fluid;

rinsing the bore(5) with a rinsing fluid (7); and subjecting a pressure-actuated adjusting member (38) of the flow limiter (30) to pressure of the rinsing fluid (7), and controlling a flow volume of the rinsing fluid with a force-operated second pressure limiter (52) dependent on pressure of the hydraulic fluid in hydraulic fluid conduit means (25).

10. A method according to claim 9, comprising the step of providing at least one of the pneumatic, hydraulic, and mechanical means for connecting the pressure-actuated adjusting member (78) of the first flow limiter (30) with rinsing means.

* * * * *